US007138572B2

(12) United States Patent
Gotoh

(10) Patent No.: US 7,138,572 B2
(45) **Date of Patent: *Nov. 21, 2006**

(54) PEG FOR STRINGED INSTRUMENTS

(75) Inventor: Takao Gotoh, Gunma (JP)

(73) Assignee: Gotoh Gut Co., Ltd. (JP)

( * ) Notice: Subject to any disclaimer, the term of this patent is extended or adjusted under 35 U.S.C. 154(b) by 105 days.

This patent is subject to a terminal disclaimer.

(21) Appl. No.: 10/469,722

(22) PCT Filed: Mar. 5, 2001

(86) PCT No.: PCT/JP01/01684

§ 371 (c)(1),
(2), (4) Date: Sep. 2, 2003

(87) PCT Pub. No.: WO02/19313

PCT Pub. Date: Mar. 7, 2002

(65) Prior Publication Data

US 2004/0094013 A1 May 20, 2004

(51) Int. Cl.
*G10D 3/14* (2006.01)

(52) U.S. Cl. ..... 84/304; 84/305; 84/306

(58) Field of Classification Search ..... 84/304, 84/305, 306

See application file for complete search history.

(56) References Cited

U.S. PATENT DOCUMENTS 3,240,098 A 3/1966 Hepler et al.
4,974,481 A * 12/1990 Gilbert ..... 84/306
5,203,224 A * 4/1993 Honda ..... 74/468
5,415,791 A 5/1995 Chou et al.
6,015,775 A * 1/2000 Takayama et al. ..... 508/103
2003/0070529 A1* 4/2003 Hovermann et al. ..... 84/304

FOREIGN PATENT DOCUMENTS

| | | |
|---|---|---|
| JP | 58160398 | 9/1983 |
| JP | 60169590 | 9/1985 |
| JP | 61004797 | 1/1986 |
| JP | 6344864 | 11/1988 |
| JP | 01280566 | 11/1989 |
| JP | 03174494 | 7/1991 |
| JP | 05089497 | 4/1993 |
| JP | 10312562 | 11/1998 |
| JP | 2000218097 | 8/2000 |
| JP | 2001012432 | 1/2001 |

* cited by examiner

*Primary Examiner*—Kimberly Lockett
(74) *Attorney, Agent, or Firm*—Trexler, Bushnell, Giangiorgi, Blackskstone& Marr,Ltd.

(57) ABSTRACT

The present invention provides a peg for stringed instruments, which can reduce rotational errors of a worm gear due to a backlash caused during tuning of a string as low as possible. The peg is also possible to reduce the friction at each rotational portion, to prevent it from seizing up, to greatly reduce a work time required for wiping off a fluid lubricant, and to retain a stable performance for a long time.

In the present invention, the peg for stringed instruments comprises a worm rotatable in accordance with rotation of a knob; and a worm wheel mated with the worm and communicated with a string attachment. A solid lubricating material layer is formed on a surface of at least one of the worm and the worm wheel as well as on a worm rod of the worm.

7 Claims, 7 Drawing Sheets

PEG FOR STRINGED INSTRUMENTS

RELATED/PRIORITY APPLICATION

This application is a National Phase application of International Application No. PCT/JP01/01684, filed Mar. 5, 2001.

FIELD OF THE INVENTION

The present invention relates to a peg for use in stringed instruments such as a guitar to wind and unwind a string utilizing a mated worm and worm wheel, in which the worm is arranged in coaxial with a knob, and the worm wheel is arranged in coaxial with a string attachment.

BACKGROUND OF THE INVENTION

A peg is used in a stringed instrument such as a guitar in the art to wind and unwind a string utilizing a mated worm and worm wheel. The worm is arranged in coaxial with a knob, and the worm wheel is arranged in coaxial with a string attachment. The peg of this kind comprises, as shown in FIGS. 6 and 7, a housing 52 generally secured at the head on the stringed instrument; a worm rod 58 having a worm 54 rotatable on the same axis in the housing 52 and having a knob 56 provided at one end of the rod 58 outside the housing 52; and a winding rod 64 having a worm wheel 60 mated with the worm 54 and rotatable on the same axis in the housing 52, and having a string attachment 62 formed at one end of the rod 64 outside the housing 52. The peg 50 of this kind is configured to wind and unwind a string by rotating the knob 56 to rotate the worm 54, which in turn rotates the worm wheel 60, thereby rotating the winding rod 64.

Such the peg 50 for stringed instruments utilizing the mated worm 54 and worm wheel 60 is different in purpose for use from a decelerator mechanism used in various machines, and has a purpose for tuning the string. Therefore, there are restrictions on the attachment and usage of the peg because of the frequent use of one portion of the worm and worm wheel and the specialty of the stringed instrument. Accordingly, it is required to provide a larger mating clearance (gap) between the worm and the worm wheel than those in other various machines.

In order to allow the thus configured worm 54 and worm wheel 60 to rotate smoothly, special lead angles are given to grooves of the worm 54 and teeth of the worm wheel 60. In addition, a clearance A at the mating portion between the worm 54 and the worm wheel 60 is formed slightly larger. When the thus mated worm 54 is rotated, a surface of the groove of the worm 54 is press-contacted with a surface of the tooth of the worm wheel 60, resulting in a friction force, which rotates the worm wheel 60 smoothly. In this case, the press-contacted surfaces of the worm 54 and the worm wheel 60 suffer from friction heat due to rotations and may seize up possibly. Therefore, the worm 54 is generally composed of a harder material and the worm wheel 60 a slightly softer material to prevent both from seizing up. Through frequent tuning and long-term use, however, the tooth surface of the worm wheel 60 is worn to reduce durability thereof. In addition, when the worm rod 58 rotates, friction heat arises at a portion between the worm rod 58 and its rolling bearing. The friction heat may also cause the worm rod 58 to seize up possibly.

With respect to the portion of the rolling bearing around the worm 54 and the mating portion between the worm 54 and the worm wheel 60, it is required to prevent them from seizing up and achieving their smooth rotations using a certain means. As that means, a lubricant, including grease and lubricating oil, (hereinafter referred to as a "fluid lubricant") is injected into the mating portion and into the worm rod 58 and its bearing. If the fluid lubricant adheres to a worker's hand while assembling the peg, and the adhered fluid lubricant then adheres to the body of the peg 50 or the knob 56, much expense in time and effort may be required to sweep out the adhered fluid lubricant from them. In addition, when the peg 50 is attached to the instrument, dirt and wood chips in the factory may adhere to the peg 50 and contaminate the worker's hand. The contaminated hand frequently contaminates the whole instrument, which requires a long period of time to be cleaned up. In particular, a mat-painted instrument requires extremely careful handling, which inevitably produces a loss in assemble time.

When a player employs the peg 50 for tuning, the touch felt at the player's finger is required as gentle and smooth as possible. The fluid lubricant, however, is naturally deteriorated. Accordingly, it can not retain the touch for a long term. In addition, it may invite a trouble to the smooth rotation of the worm 54 and the worm wheel 60. Further, in the conventional peg 50 of this type, as described above, the larger clearance A is formed at the mating portion between the worm 54 and the worm wheel 60. The presence of such the larger clearance A produces a large backlash in the normal direction during frequent winding and unwinding for tuning. As a result, a problem arises because the large backlash not only makes it uneasy to achieve fine-tuning but also makes it difficult to achieve re-tuning by the player during a performance.

As described above, the presence of the larger clearance A between the groove of the worm 54 and the tooth of the worm wheel 60 produces a backlash in the normal direction during winding and unwinding of the string. Due to the backlash, it is inevitable for the worm 54 to rotate ineffectively during winding and unwinding of the string while the tooth of the worm wheel 60 relatively travels over the backlash in the normal direction. Therefore, the operation of the knob 56 is not synchronized with the rotation of the winding rod 64 at the beginning of the operation of the knob 56, resulting in a strange feeling on fine-tuning and a difficulty for the player to achieve re-tuning during a performance.

The backlash in the normal direction is shown in FIG. 7 with the symbol A'. When the worm 54 is rotated in the direction of winding the string (the worm wheel 60 clockwise), for example, one wall 54*a* of the worm 54 is press-contacted with a tooth 60*a* of the worm wheel 60. Accordingly, the backlash is formed between the non-contact side of the tooth 60*a* of the worm wheel 60 and the other wall 54*b* opposing thereto. The backlash A' in the normal direction is generally retained in the current state when the worm wheel 60 is in the state of winding the string because the worm 54 is held by the friction force from the bearing and the like that effects on the worm. When the worm 54 is rotated in the direction of unwinding the string (the worm wheel 60 counterclockwise) to the contrary, the tooth 60*a* of the worm wheel 60 is required to travel over the backlash A' in the normal direction in order to press-contact the tooth 60*a* of the worm wheel 60 with the non-contact wall 54*b* in a groove 54*c* of the worm 54. Therefore, a time lag occurs between the starting point of operating the knob 56 and the starting point of unwinding the string. The length of this time lag may disturb the feeling on fine-tuning.

The present invention has an object to provide a peg for stringed instruments. This peg requires no fluid lubricant injected into the mating portion between the worm and the worm wheel to achieve smooth rotations of the worm and the worm wheel even if the mating clearance (the backlash in the normal direction) between the worm and the worm wheel is minimized. In addition, the peg is possible to reduce rotational errors caused by the backlash during tuning and re-tuning as low as possible to allow a player to easily achieve fine-tuning even during a performance. Further, the peg is possible to greatly simplify the work for attaching the peg to the instrument and improve the work efficiency. Furthermore, the peg is possible to reduce the friction at the mating portion between the worm and the worm wheel and the friction between the worm rod and its rolling bearing during even frequent winding and unwinding to decrease their abrasion as low as possible so as to give durability to the peg.

SUMMARY OF THE INVENTION

To achieve the above object, a peg for stringed instruments in the present invention comprises a worm rotatable in accordance with rotation of a knob; and a worm wheel mated with the worm and communicated with a string attachment, wherein a solid lubricating material layer is formed on a surface of at least one of the worm and the worm wheel. In this case, preferably, the solid lubricating material layer may also be formed on a surface of a worm rod of the worm. Preferably, the solid lubricating material layer may have a thickness adjusted to contact the grooves of the worm lightly with the teeth of the worm wheel to reduce a clearance between both as small as possible.

Preferably, the solid lubricating material layer is formed as follows. (A) The solid lubricating material layer includes a lubricant consisting of a powder or particulate of molybdenum disulfide, organic molybdenum or graphite; and a binder consisting of an epoxy resin with tight adhesion and high hardness, which are baked on the worm, the worm wheel or the worm rod to form the layer. (B) The solid lubricating material layer includes an electroless compound plated layer of nickel/fluororesin such as poly(tetrafluoroethlene), which is formed on the worm, the worm wheel or the worm rod. (C) The solid lubricating material layer includes an electrolytic compound plated layer of nickel/fluororesin such as poly(tetrafluoroethlene); and a plated layer of metal such as chrome, which is formed on the worm, the worm wheel or the worm rod. (D) The solid lubricating material layer includes an electrolytic compound plated layer of nickel/fluororesin such as poly(tetrafluoroethlene); and a plated layer of metal such as chrome, and wherein the plated layers are formed on the worm, the worm wheel or the worm rod through heating. Preferably, the compound plated layer may be of the following types. In one type, when the surface metal plated layer is worn after a long-term use, the inner compound plated layer consisting of the fluororesin appears through the surface. In another type, particulate of an abrasion resistive fluororesin is uniformly co-precipitated in the surface metal plated layer.

According to the present invention, the compound plated layers are formed on the surfaces of at least one of the worm and the worm wheel and of the worm rod. Therefore, even if a fluid lubricant is not injected into the mating portion between the worm and the worm wheel and the portion between the worm rod and its bearing, an appropriate combination of these layers enables the mating portion and the bearing portion to retain their smoothness. In addition, it is possible to reduce friction heat arising at these portions as low as possible. It is also possible to prevent the mating portion between the worm and the worm wheel and the bearing portion around the worm rod from seizing up.

When the compound plated layer is formed on the surface of at least one of the worm and the worm wheel, the layer fills the clearance at the mating portion between the worm and the worm wheel so as to contact the worm lightly with the worm wheel while the worm and the worm wheel can rotate without any trouble with the thickness of the layer adjusted to some extent. Therefore, it is possible to reduce the backlash in the normal direction as small as possible arising during winding and unwinding of the string. This facilitates easy fine-tuning to be achieved even during a performance with the instrument.

If a solid lubricating material layer is formed on the mating portion between the worm and the worm wheel, the mating portion has a reduced friction resistance and becomes slidable. Therefore, the worm wheel tends to rotate in reverse. In the stringed instrument, however, a string has a relatively low tension. Accordingly, the worm rod can be sufficiently prevented from rotating in reverse by the friction resistance between the worm and the worm wheel, and the friction resistance between the knob that is provided integrally with the worm and the housing that accommodates the worm and so forth. The reverse rotation of the worm wheel can be prevented positively using a worm thrust-fixing and rotational torque-adjusting screw generally provided in the worm-rotating knob. When this screw is fastened, the rotational friction can be increased. Thus, the rotational torque-adjusting screw is adjusted to prevent the reverse rotation of the worm. In a type that is not provided with such the rotational torque-adjusting screw, the reverse rotation of the worm may be prevented by increasing the rotational friction resistance at the bearing of the worm or changing the module of or the lead angle between the worm and the worm wheel.

According to the present invention, in the case of the solid lubricating material layer that includes an epoxy resin mixed with one or more of molybdenum disulfide, organic molybdenum and graphite and baked, the layer is rich not only in adhesion to a ground material for baking but also in abrasion resistance, durability and lubrication with high hardness. Accordingly, it enables the peg to be used smoothly over a long term.

In the case of the solid lubricating material layer that includes an electrolytic compound plated layer of nickel/fluororesin such as poly(tetrafluoroethlene); and a plated layer of metal such as chrome, if an electroless compound plated layer is formed on the worm and the worm rod, for example, the solid lubricating material layer including the electrolytic compound plated layer and the metal plated layer may be formed on the worm wheel. In this case, even if the metal plated layer is worn through use, the lower electrolytic compound plated layer appears through the surface. Therefore, the solid lubricating material layer is rich in lubrication similar to that in the case of the electroless plating, and is further provided with more effective abrasion resistance than that achieved in the electroless plating. Thus, it is suitable for use in a peg of an open type with no housing.

In the case of the solid lubricating material layer that includes an electroless compound plated layer of nickel/fluororesin such as poly(tetrafluoroethlene), when it is used in a peg of an open type with no housing, the same effect as above can be achieved. Further, it is excellent in appearance with luster on the worm and the worm wheel, resulting in an improved commodity value.

In the case of the solid lubricating material layer that includes an electrolytic compound plated layer of nickel/fluororesin such as poly(tetrafluoroethlene); and a plated layer of metal such as chrome, which plated layers are heated, particulate of the fluororesin can be uniformly co-precipitated in the surface layer of chrome coating. Therefore, the solid lubricating material layer is rich in lubrication similar to that in the case of the electroless plating, and is further provided with more effectively uniformed abrasion resistance and durability than those achieved in the electroless plating. Thus, it is suitable for use in a peg of an open type with no housing similar to that in the non-heated plated layer.

In the peg for stringed instruments according to the present invention, the solid lubricating material layer is preferably formed on the surfaces of the worm and the worm wheel. The solid lubricating material layer may be formed on both the worm and the worm wheel or only on the worm wheel depending on the instrument type and the purpose for use.

DETAILED DESCRIPTION OF THE EMBODIMENTS

Figure 1:
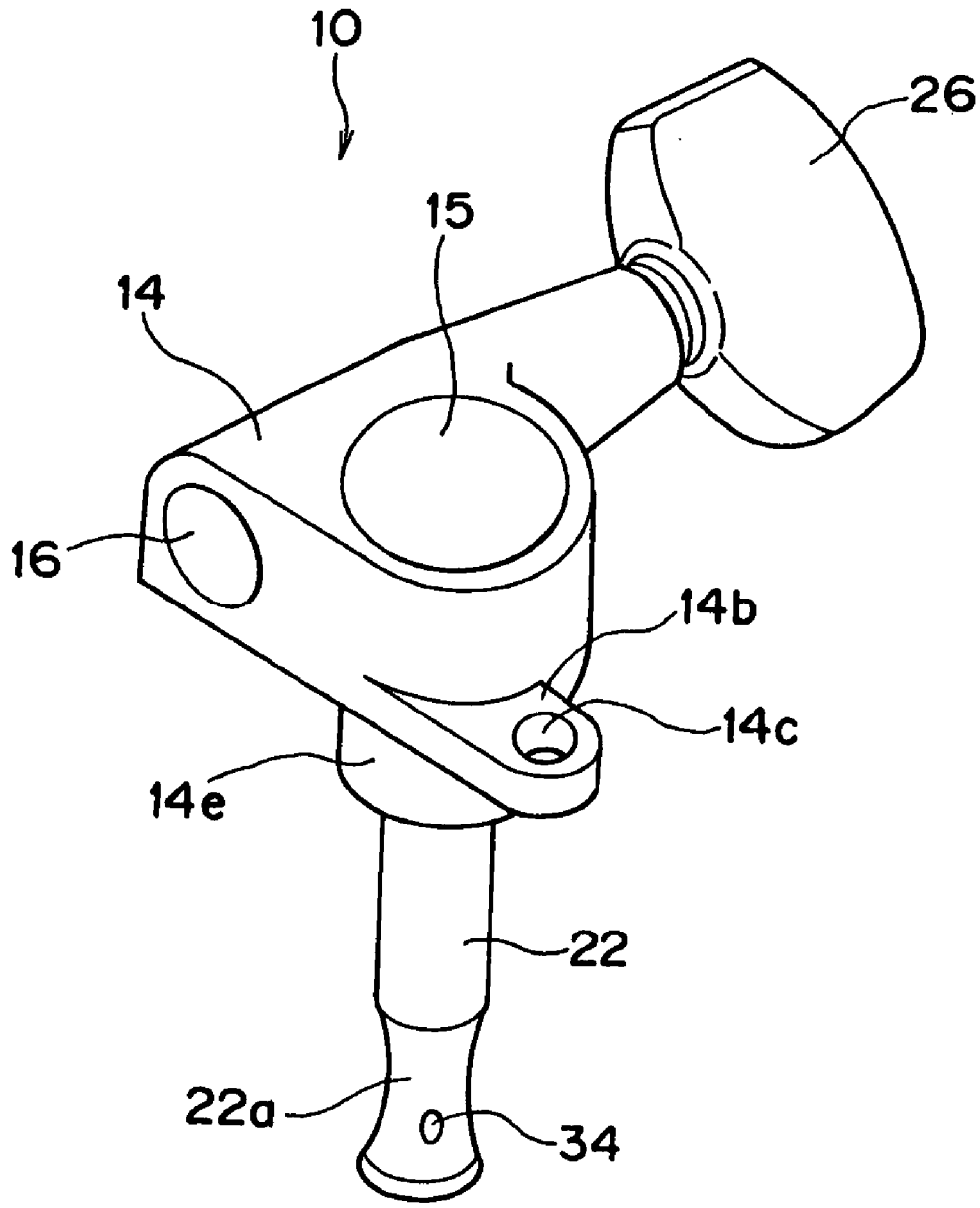
FIG. 1 is a whole perspective view showing an embodiment of a peg for stringed instruments according to the present invention.
Figure 2:
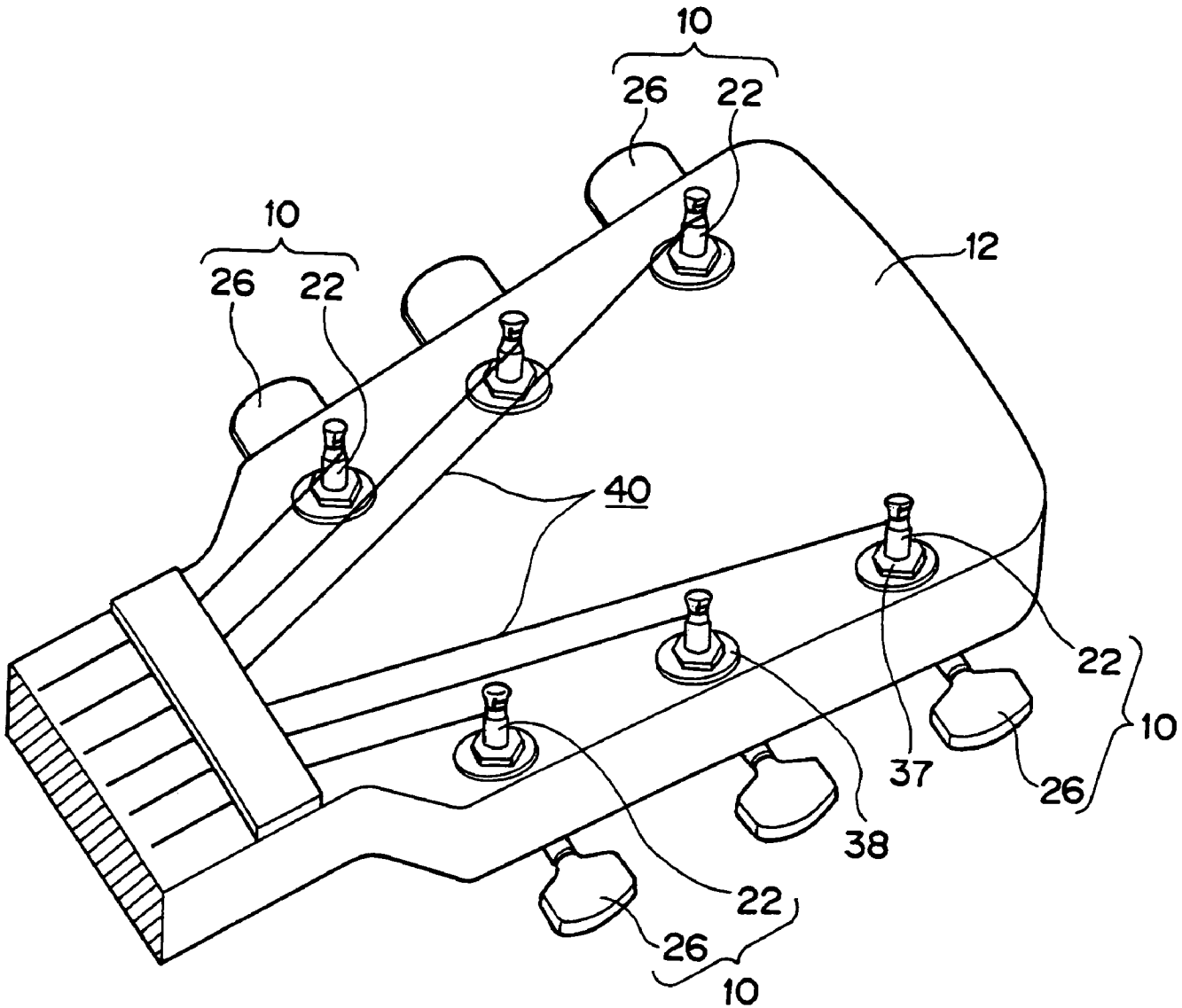
FIG. 2 is a perspective view showing the peg for stringed instruments according to the embodiment mounted on an instrument head.

An embodiment of a peg for stringed instruments according to the present invention will be described next with reference to the drawings.

The peg 10 according to the embodiment comprises a housing 14 secured on an instrument head 12; a worm rod 18 formed integrally with a worm 16 rotatable in the housing 14; and a winding rod 22 having an end attached to a worm wheel 20 that is rotatably mated with the worm 16 at right angle in the housing 14.

Figure 3:
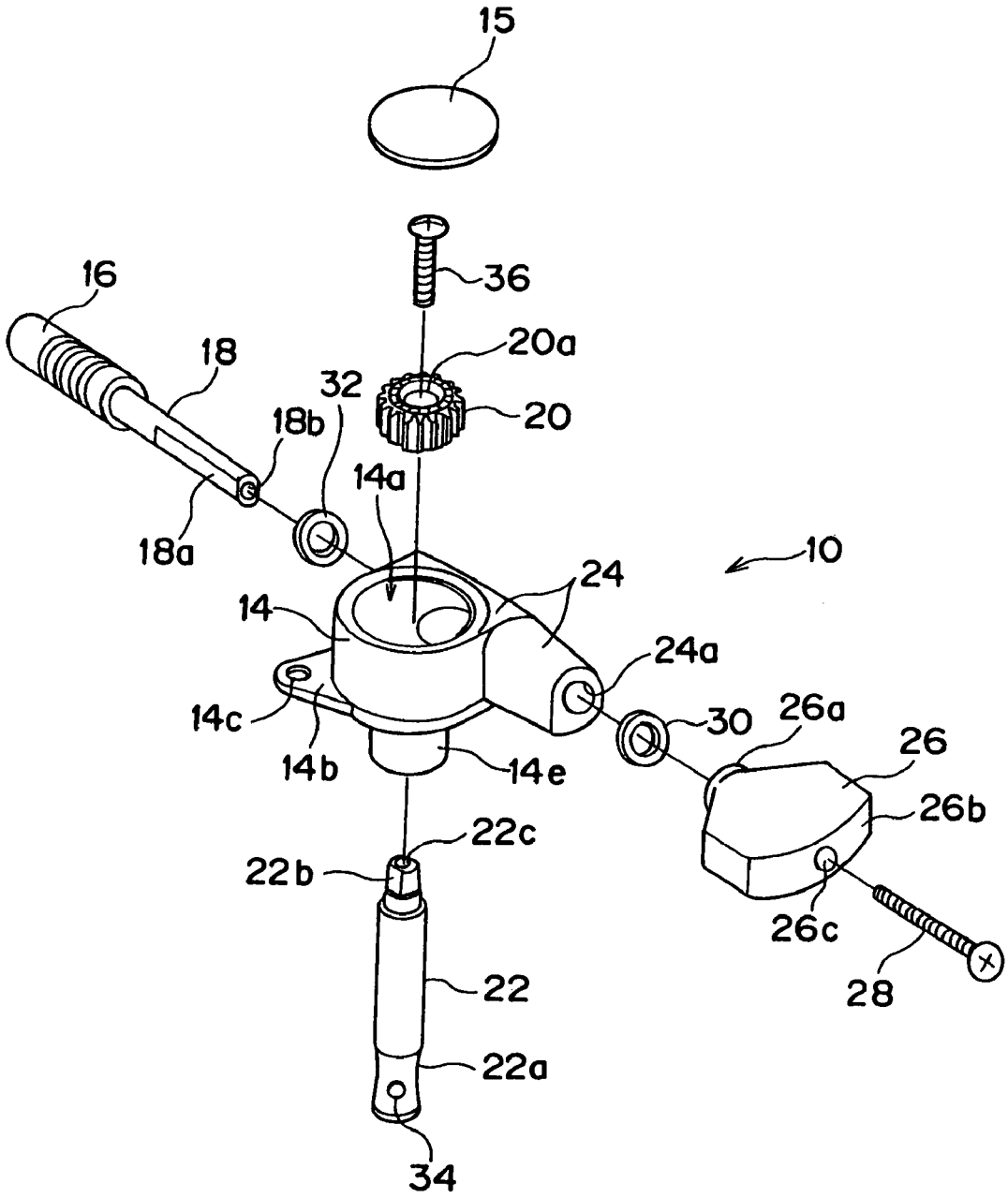
FIG. 3 is an exploded view of the peg for stringed instruments according to the embodiment.

The housing 14 has an aperture 14*a* formed in the open upper surface, as shown in FIG. 3. The aperture 14*a* can be closed with a lid 15. The housing 14 has a cylindrical attachment piece 14*e* at the bottom, which has a female screw 14*f* formed on its inner surface. The piece is employed to insert and secure the peg 10 in a peg attachment hole 12*a* previously formed in the instrument head 12. A rod support hole 14*d* for supporting the winding rod 22 is formed at the center of the piece.

The aperture 14*a* of the housing 14 is shaped cylindrical suitable for housing the worm wheel 20. At the side of the housing 14, a worm rod-housing portion 24 is formed to house the worm rod 18 that intersects at right angle with the winding rod 22. The worm rod-housing portion 24 has a worm rod support bore 24*a* to receive the worm rod 18 inserted therein. The worm rod support bore 24*a* is formed to project the front end 18*a* of the worm rod 18 from the worm rod-housing portion 24 to outside and house the worm 16 of the worm rod 18 entirely in the housing 14.

The worm rod support bore 24*a* formed in the worm rod-housing portion 24 is configured to communicate with the aperture 14*a* in the housing 14. When the worm rod 18 is housed in the worm rod-housing portion 24, a portion of the worm 16 projects from the worm rod-housing portion 24 into the aperture 14*a* of the housing 14 and mates with the worm wheel 20. From the side of the housing 14 opposite to the worm rod-housing portion 24, a flange 14*b* protrudes. The flange 14*b* has a screw hole 14*c* formed in parallel with the inserting direction of the winding rod 22. A screw (not shown) is inserted into the screw hole 14*c* of the flange 14*b* and screwed in a certain position on the rear surface of the instrument head 12 to determine the position of the peg 10 to be attached. A cylindrical nut 37 for securing the peg is employed together with a washer 38. The nut has a male screw 37*a* formed on the outer surface of the cylindrical body to mate with the female screw 14*f* formed on the inner surface of the cylindrical attachment piece 14*e* at the bottom of the housing 14. It also has a bore 37*b* formed at the center thereof to receive the winding rod 22 inserted therein, and a hexagonal head. When the cylindrical body of the cylindrical nut 37 is inserted into the peg attachment hole 12*a* formed in the instrument head 12, and the cylindrical nut 37 is mated with the female screw 14*f* in the cylindrical attachment piece 14*e*, the peg 10 according to the present invention can be fixedly arranged on a certain position in the instrument head 12.

The worm rod 18 has the worm 16 formed on the outer surface at the rear end. The front end 18*a* of the worm rod 18 is shaped in a square rod. The square-rod-shaped front end 18*a* is configured to project from the worm rod-housing portion 24 to outside when the worm rod 18 is housed in the worm rod-housing portion 24. The front end 18*a* of the worm rod 18 projected from the worm rod-housing portion 24 is attached to the knob 26. The rear end 26*a* of the knob 26 has a fitting square bore 26, which is formed to fit with the square-rod-shaped front end 18*a* of the worm rod 18. The fitting square bore 26 communicates with a screw insertion hole 26*c* formed at the center of the front end 26*b* of the knob 26. A screw hole 18*b* is formed in the tip of the worm rod 18. A knob fixing screw 28 is inserted into the screw insertion hole 26*c*, then screwed and secured in the screw hole 18*b*.

As described above, the worm rod 18 is housed in the worm rod-housing portion 24 such that the front end 18*a* of the worm rod 18 projects from the worm rod-housing portion 24 to outside. The projected front end 18*a* of the worm rod 18 is fitted in the fitting square hole 26*d* of the knob 26, then the knob fixing screw 28 is inserted through the screw insertion hole 26*c* and screwed in the screw hole 18*b* of the worm rod 18. Thus, the worm rod 18 is rotatably attached in the housing 14 and the knob 26 is fixedly secured to the worm rod 18.

As shown, the square-rod-shaped front end 18*a* of the worm rod 18 is fitted in the fitting square hole 26*d* of the knob 26. Therefore, the rotation of the knob 26 allows the worm rod 18 to rotate relative to the housing 14. The worm 16 is housed in the worm rod-housing portion 24 such that a part of the worm projects into the aperture 14*a* of the housing 14 as described above. A washer 30 is interposed between the knob 26 and the worm rod-housing portion 24, and a washer 32 between the worm 16 and the worm rod-housing portion 24.

The winding rod 22 is substantially shaped in a column and has a recess 22*a* formed near the front end around the whole circumference to wind a string thereon. The recess 22*a* has a string attachment hole 34 formed therethrough to receive a string when the tip of the string is inserted therein. The rear end of the winding rod 22 is shaped in a columnar portion and square portion 22*b* that is fitted and supported in the rod support hole 14*d*. When the columnar rod of the winding rod 22 is rotatably inserted into the rod support hole 14*d* formed in the bottom of the housing 14, only the square portion 22*b* is allowed to project in the aperture of the housing 14. A fitting square hole 20*b* is formed on the inner surface at the center of the worm wheel 20. The square rod 22*b* formed at the rear end of the winding rod 22 can be fitted in the fitting square hole 20*b* , which communicates with a screw hole 20*a* formed near the surface of the worm wheel 20. A screw hole 22*c* is formed at the center of the rear end of the winding rod 22 to receive a wheel fixing screw 36 when it is screwed therein after passing through the screw hole 20*a* and the fitting square hole 20*b* in the worm wheel 20 to secure the worm wheel 20 to the winding rod 22.

Figure 4:
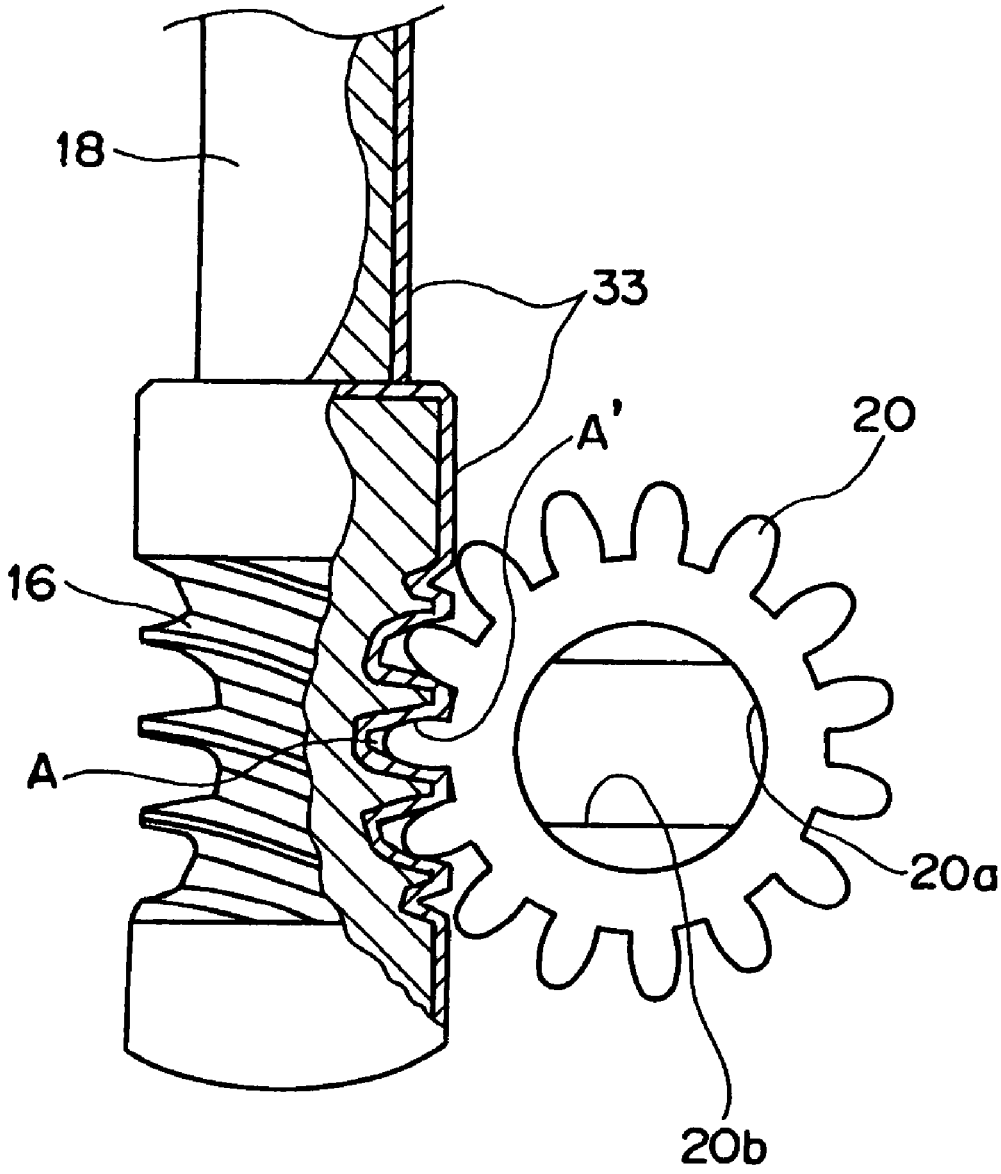
FIG. 4 is a partly sectioned cross-sectional view showing a mated worm and worm wheel in the peg for stringed instruments according to the embodiment.
Figure 5:
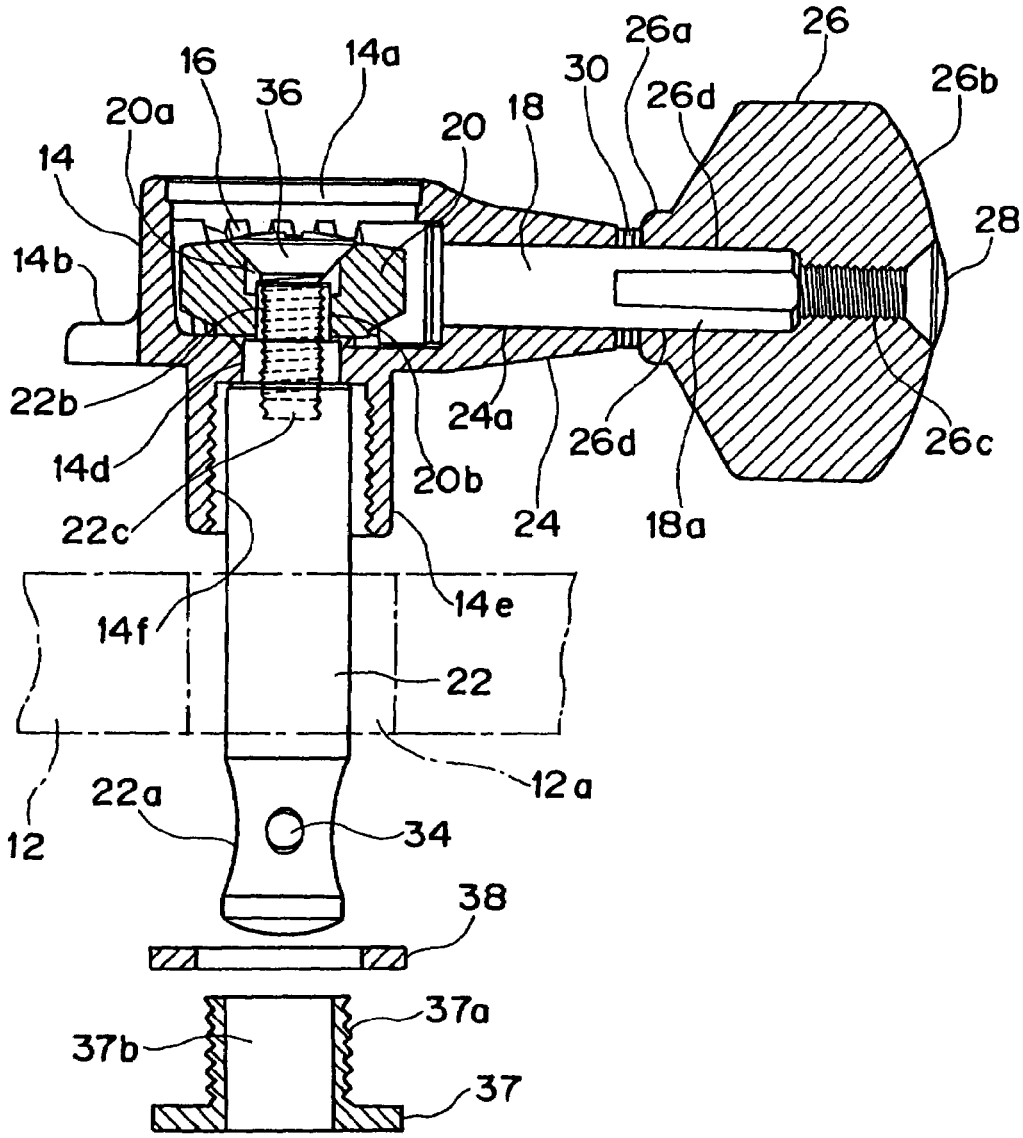
FIG. 5 is a cross-sectional view showing the main part of the peg for stringed instruments according to the embodiment during assembly.
Figure 6:
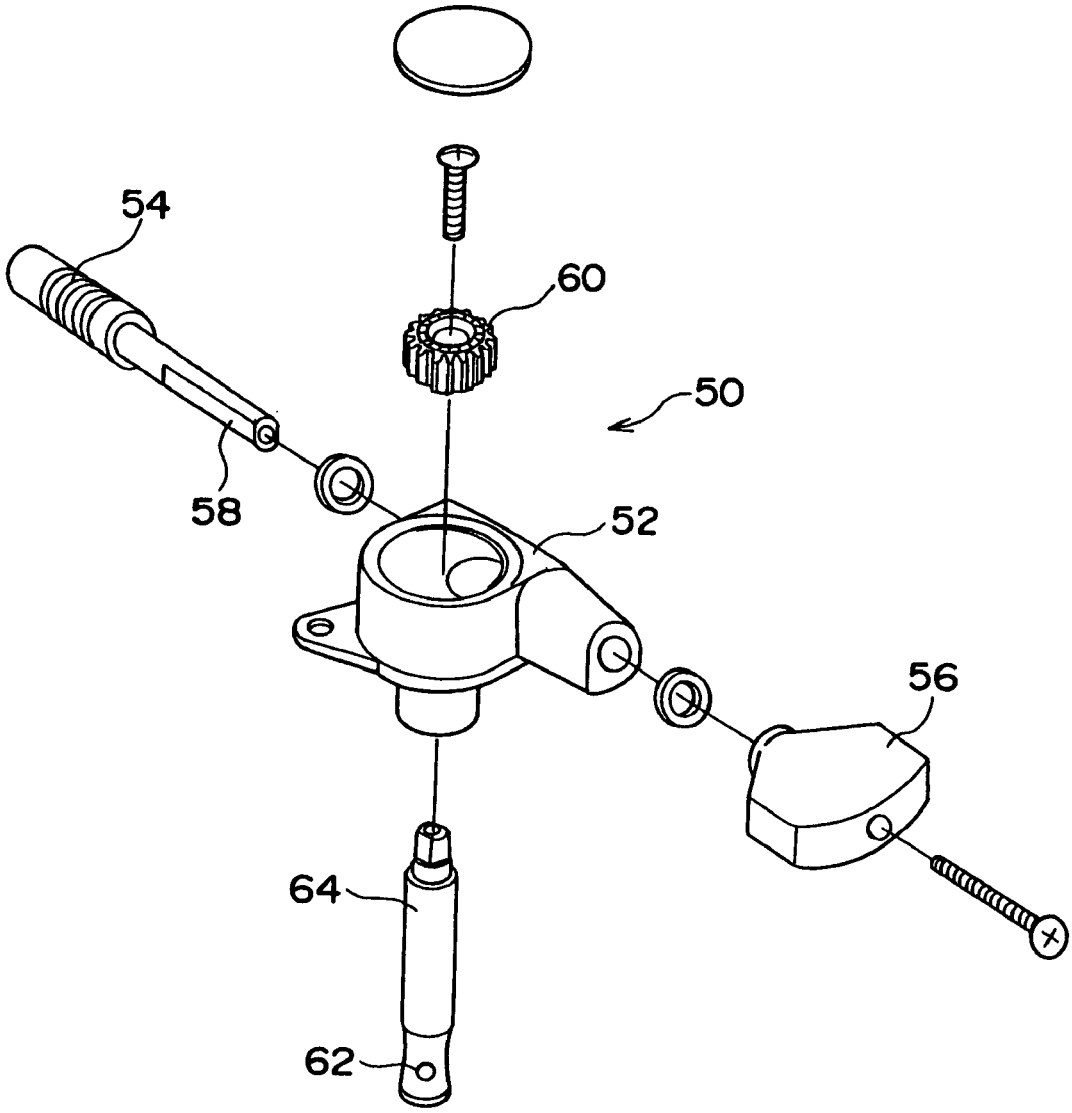
FIG. 6 is an exploded view of a conventional peg for use in a stringed instrument such as a guitar to wind and unwind a string utilizing a mated worm and worm wheel, in which the worm is arranged in coaxial with a knob, and the worm wheel is arranged in coaxial with a string attachment.
Figure 7:
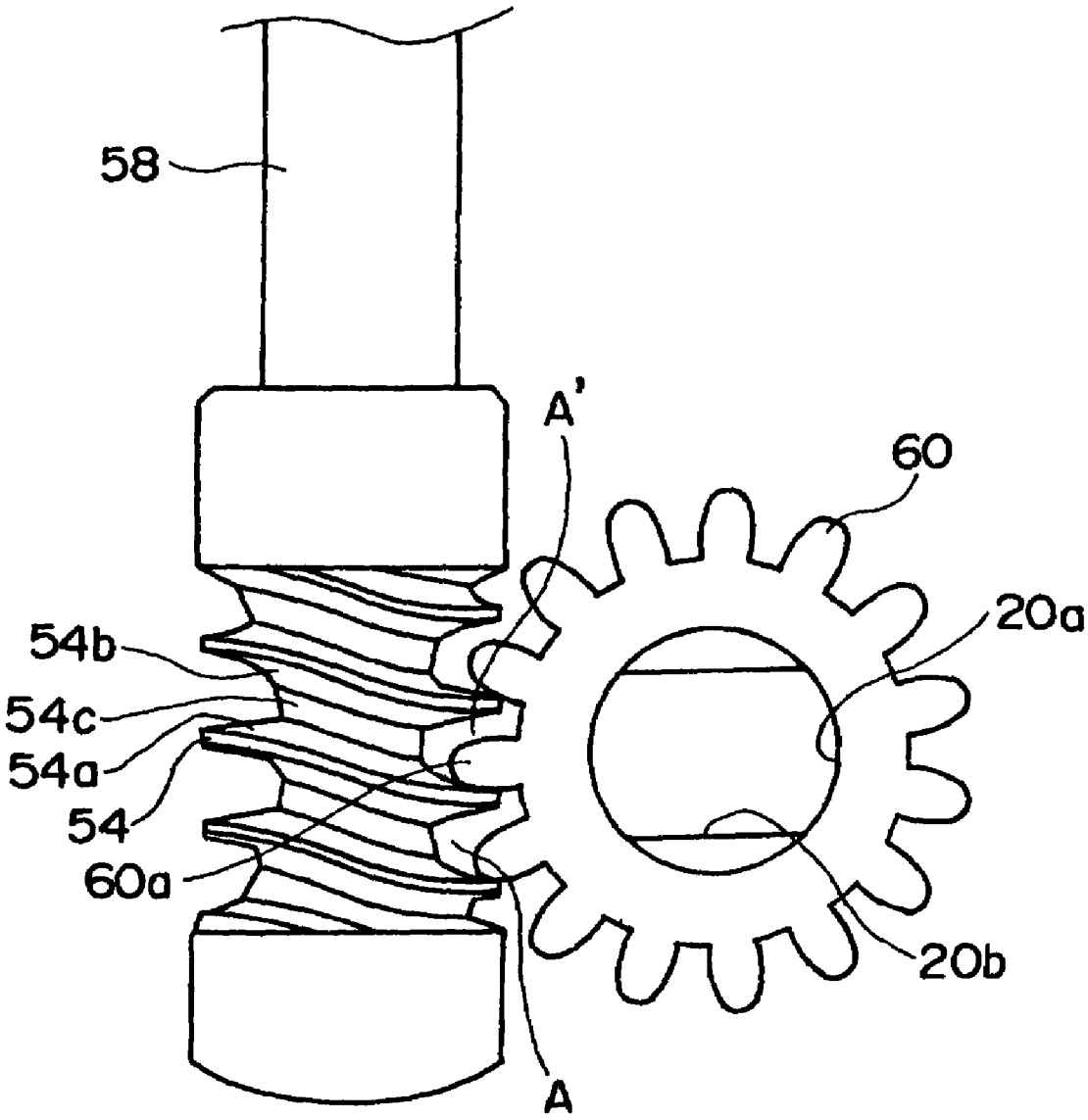
FIG. 7 is a plan view showing the main part of the mated worm and worm wheel in the conventional peg.

As shown, the winding rod 22 is inserted into the rod support hole 14*d* formed in the bottom of the housing 14 such that the square portion 22*b* of the winding rod 22 projects into the aperture 14*a* of the housing 14. The square portion 22*b* projected in the aperture 14*a* of the housing 14 is then fitted in the fitting square hole 20*b* of the worm wheel 20. The wheel fixing screw 36 is inserted next into the screw hole 20*a* of the worm wheel 20 and screwed in the screw hole 22*c* of the winding rod 22. Thus, the worm wheel 20 can be rotatably mounted within the aperture 14*a* of the housing 14, and the winding rod 22 is fixedly secured to the worm wheel 20. In this case, both sides of the tooth of the worm wheel 20 are located within the aperture 14*a* of the housing 14, as shown in FIG. 4, lightly contacting with the grooves of the worm 16 having a solid lubricating material layer 33 formed thereon, remaining a minimum clearance (gap) required for rotation.

The following detailed description is given to a method of forming a solid lubricating material layer over the surfaces of the worm 16 and the worm rod 18.

In the case of a solid lubricating material layer 33 that includes a lubricant consisting of a powder or particulate of molybdenum disulfide, organic molybdenum or graphite; and a binder consisting of an epoxy resin, it can be formed over the surfaces of the worm 16 and the worm rod 18 in a method, which comprises mixing a lubricant consisting of a powder or particulate of one or more of molybdenum disulfide, organic molybdenum and graphite with a binder consisting of an epoxy resin with tight adhesion and high hardness; diluting the mixture in a solvent to produce a matrix of a paint-type solid lubricating material; spray-painting the matrix onto the worm 16 and the worm rod 18 or immersing the worm 16 and the worm rod 18 in the matrix to paint the solid lubricating material on them; and heating them to complete the solid lubricating material layer 33 baked.

In the case of a solid lubricating material layer that includes an electroless compound plated layer of nickel/fluororesin such as poly(tetrafluoroethlene), it can be formed over the surfaces of the worm 16 and the worm rod 18 in a method, which comprises mixing a powder or particulate of poly(tetrafluoroethlene) into an ordinary electroless nickel plating solution; immersing the worm 16 and the worm rod 18 in the mixed solution; applying a conventional method of electroless plating to complete the solid lubricating material layer 33.

In the case of a solid lubricating material layer that includes an electrolytic compound plated layer of nickel/fluororesin such as poly(tetrafluoroethlene); and a plated layer of metal such as chrome, it can be formed over the surfaces of the worm 16 and the worm rod 18 in a method, which comprises mixing a powder or particulate of poly (tetrafluoroethlene) into an ordinary electrolytic nickel plating solution or an ordinary electrolytic nickel sulfamate plating solution; immersing the worm 16 and the worm rod 18 in the mixed solution; and applying a conventional method of electroplating. The method further comprises immersing the electroplated worm 16 and worm rod 18 into an ordinary electrolytic chrome plating solution; and applying a conventional method of electroplating to complete the solid lubricating material layer 33 consisting of the compound plated layer.

In the case of a solid lubricating material layer that includes an electrolytic compound plated layer of nickel/fluororesin such as poly(tetrafluoroethlene); and a plated layer of metal such as chrome, which plated layers are heated, it can be formed over the surfaces of the worm 16 and the worm rod 18 in a method, which comprises mixing a powder or particulate of poly(tetrafluoroethlene) into an ordinary electrolytic nickel plating solution or an ordinary electrolytic nickel sulfamate plating solution; immersing the worm 16 and the worm rod 18 in the mixed solution; and applying a conventional method of electroplating. The method further comprises immersing the electroplated worm 16 and worm rod 18 into an ordinary electrolytic chrome plating solution; and applying a conventional method of electroplating to complete the compound plated layer. The method still further comprises heating the compound-plated worm 16 and worm rod 18 to complete the solid lubricating material layer 33 consisting of the compound plated layer that includes the surface layer of chrome coating containing the particulate of poly(tetrafluoroethlene) uniformly co-precipitated therein.

According to such the method, the solid lubricating material layer is formed slightly thicker than a certain layer thickness. In a word, the layer is formed so as to fill the clearance A formed at the mating portion between the worm 16 and the worm wheel 20 to some extent without inviting any trouble to the rotations of the worm 16 and the worm wheel 20. The grooves of the worm 16 and the teeth of the worm wheel 20 are then mated with each other and subjected to training rotations until the layer thickness reaches an optimal value to abrasively adjust the layer thickness. Thus, the grooves of the worm 16 and the teeth of the worm wheel 20 are put in a light contact state for use.

The peg thus configured is assembled in the same manner as for the conventional peg. The worm 16 and the worm rod 18 are inserted through the one side of the worm rod-housing portion 24 and located therein such that the worm 16 is located within the aperture of the housing 14 and the worm rod 18 is located within the worm rod-housing portion 24. The washer 32 is interposed between the one side of the worm rod-housing portion 24 and the side of the worm 16.

The front end 18*a* of the worm rod 18, or the square rod portion, projected from the other side of the worm rod-housing portion 24 is fitted via the washer 30 in the square fitting hole 26*d* of the knob 26. The knob fixing screw 28 passed through the screw insertion hole 26*c* of the knob 26 is then screwed in the screw hole 18*b* of the worm rod 18 to integrate the knob 26 with the worm rod 18.

The rear end of the winding rod 22 is inserted through the rod support hole 14*d* at the bottom of the housing 14 to project the square portion 22*b* into the aperture 14*a* of the housing 14. The square portion 22*b* is fitted in the square fitting hole 20*b* of the worm wheel 20, of which teeth are mated with the worm 16. The wheel fixing screw 36 is then inserted through the screw hole 20*a* of the worm wheel 20 and screwed in the screw hole 22*a* of the winding rod 22 to secure the worm wheel 20 to the winding rod 22. Finally, the aperture 14*a* of the housing 14 is covered with the lid 15 to finish the assembly.

The peg thus assembled is attached to the instrument head 12 in the following manner. The cylindrical attachment piece 14*e* of the housing 14 is inserted from a certain direction into the peg attachment hole 12*a* that is previously formed at a certain position in the instrument head 12. The cylindrical body of the hexagonally headed cylindrical nut 37 is inserted into the hole 12*a* via the washer 38 from the other direction. The male screw 37*a* of the cylindrical nut 37 is lightly screwed for provisional fixation in the female screw 14*f* of the cylindrical attachment piece 14*e*. A fixing screw is inserted through the screw hole 14*c* of the flange 14*b* and screwed in the instrument head 12 for positioning the peg 10 to be attached. Thereafter, the male screw 37*a* is strongly screwed for final fixation in the female screw 14*f*. In addition, the fixing screw for positing is also strongly screwed to secure the peg 10 at the certain position of the instrument head 12.

The peg thus attached to the certain position of the instrument is used in the same manner as is in the art. Each string 40 has a winding end, which is inserted into the string attachment hole 34 of the respective winding rod 22. When the knob 26 is rotated, the string 40 is wound up around the winding rod 22. When the knob 26 is rotated in the direction of winding the string, the worm 16 rotates in the positive direction together with the worm rod 18. In addition, the worm wheel 20 rotates the winding rod 22 integrated with the worm wheel 20 in the direction of winding the string to wind the string 40 up. When the knob 26 is rotated in the reverse direction to unwind the string 40, the winding rod 22 rotates in the reverse direction, and the operation opposite to the above unwinds the string 40.

The mating portion between the worm 16 and the worm wheel 20 has the clearance A, which is determined to an extent as slight as inviting no trouble to their rotations. Therefore, the teeth and the grooves of both are lightly contacted with each other. In this case, the worm rod 18 is tightly contacted with the worm rod support hole 24*a* of the worm rod-housing portion 24. For the tightly-contacted portion between those, however, the solid lubricating material layer 33 formed over the surfaces of the worm 16 and the worm rod 18 serves as a lubricant to prevent the portion from seizing up and greatly reduce the friction resistance. This is effective for the worm 16 to achieve stabilized smooth rotations of the worm wheel 20. The worm 16 is employed to rotate the worm wheel 20 to wind or unwind the string 40. In this case, the mating portion between the worm 16 and the worm wheel 20 has the slight clearance A only. Therefore, the rotational errors due to the backlash A' in the normal direction can be reduced as low as possible for either winding or unwinding the string 40.

In the arrangement shown in the above embodiment, the backlash A' in the normal direction slightly remains. According to the present invention, it is possible to increase and decrease the thickness of the solid lubricating material layer 33. The thicker solid lubricating material layer 33 may enable the grooves of the worm 16 and the teeth of the worm wheel 20 to mate and lightly contact with each other, thereby eliminating the backlash A'.

Preferably, the solid lubricating material layer 33 has flexibility in accordance with the thickness of the material layer 33 to absorb the contact pressure at the mating portion between the grooves of the worm 16 and the teeth of the worm wheel.

This embodiment shows the peg with the housing 14, and the peg with the solid lubricating material layer 33 only formed on the worm 16 and the worm rod 18. Alternatively, the solid lubricating material layer 33 may be formed on either or both of the worm 16 and the worm wheel 20. These are similarly applicable to the peg, in which the worm and worm wheel is not housed in a housing but exposed to the ambient and attached to the instrument head 12, as is in a peg 10 of the so-called open type.

Thus, in the present invention, no fluid lubricant is injected into the mating portion between the worm and the worm wheel and into the portion between the rolling bearing and the worm. In addition, the backlash in the direction of the normal at the mating portion between the worm and the worm wheel is minimized within a necessary condition. Even though, the worm and the worm wheel can rotate smoothly, and the rotational errors due to the backlash during tuning and re-tuning can be reduced as low as possible. Therefore, even a player unfamiliar to tuning can easily perform tuning and re-tuning any time. Further, the friction at the mating portion between the worm and the worm wheel can be reduced for frequent winding and unwinding during tuning to prevent it from wearing. Thus, a durable peg for stringed instruments can be obtained.

Further, because no fluid lubricant is employed, the stringed instrument is not contaminated during the work for attaching the peg to the instrument. In addition, because the work for wiping off the fluid lubricant can be omitted, the work for attaching the peg to the instrument is extremely simplified. This is effective not to invite a quality reduction to the instrument, to reduce works and efforts, to speed the peg attachment work, and to reduce costs.

What is claimed is:

1. A peg for stringed instruments, comprising: a worm rotatable in accordance with rotation of a knob; and a worm wheel mated with said worm and communicated with a string attachment, wherein a solid lubricating material layer is formed on a top surface of the worm, said solid lubricating material filling a clearance at a mating portion between said worm and said worm wheel such that at least one of the teeth of the worm wheel simultaneously contacts a pair of walls of the worm, wherein a groove of the worm is disposed between the walls.

2. The peg for stringed instruments according to claim 1, wherein said solid lubricating material layer is formed on a surface of a worm rod of said worm.

3. The peg for stringed instruments according to claim 1, wherein said solid lubricating material layer includes: a lubricant consisting of a powder or particulate of molybdenum disulfide, organic molybdenum or graphite; and a binder consisting of an epoxy resin, which are baked to form said layer.

4. The peg for stringed instruments according to claim 1, wherein said solid lubricating material layer includes a layer of nickel/fluororesin.

5. The peg for stringed instruments according to claim 1, wherein said solid lubricating material layer includes: an electrolytic compound plated layer of nickel/fluororesin and a plated layer of metal.

6. The peg for stringed instruments according to claim 1, wherein said solid lubricating material layer includes: an electrolytic compound plated layer of nickel/fluororesin; and a plated layer of metal, and wherein said plated layers are formed through heating.

7. The peg for stringed instruments according to claim 1, wherein said solid lubricating material layer is formed on a surface of at least one of a portion of grooves of said worm and a portion of teeth of said worm wheel, said layer having a thickness adjusted to contact said grooves of said worm lightly with said teeth of said worm wheel.

* * * * *